US006568002B1

(12) United States Patent
Liljedahl

(10) Patent No.: US 6,568,002 B1
(45) Date of Patent: May 27, 2003

(54) LATERAL SUPPORT OF A HOIST

(75) Inventor: Gunnar Liljedahl, Luleå (SE)

(73) Assignee: Liko Research & Development AB, Lulea (SE)

( * ) Notice: Subject to any disclaimer, the term of this patent is extended or adjusted under 35 U.S.C. 154(b) by 0 days.

(21) Appl. No.: 09/868,659

(22) PCT Filed: Dec. 15, 1999

(86) PCT No.: PCT/SE99/02378

§ 371 (c)(1),
(2), (4) Date: Jul. 3, 2001

(87) PCT Pub. No.: WO00/44328

PCT Pub. Date: Aug. 3, 2000

(30) Foreign Application Priority Data

Jan. 27, 1999 (SE) ..... 9900255

(51) Int. Cl.[7] ..... A61G 7/08
(52) U.S. Cl. ..... 5/86.1; 5/81.1 R
(58) Field of Search ..... 5/86.1, 81.18 R, 5/87.1, 89.1; 280/304.1, 250.1, 47.35

(56) References Cited

U.S. PATENT DOCUMENTS 3,277,502 A * 10/1966 Wauthier ..... 280/304.1
4,704,749 A * 11/1987 Aubert ..... 280/250.1
4,918,771 A 4/1990 James ..... 5/81
4,985,947 A 1/1991 Ethridge ..... 5/81
5,022,106 A 6/1991 Richards ..... 5/86
5,819,338 A 10/1998 Hession ..... 5/86

* cited by examiner

*Primary Examiner*—Teri Pham Luu
*Assistant Examiner*—Fredrick Conley
(74) *Attorney, Agent, or Firm*—Jacobson Holman PLLC

(57) ABSTRACT

Aid apparatus for raising a disabled person from a sitting position to a standing position, which apparatus includes a wheeled base in the form of a U-formed frame having a post, which supports a lifting device. The lifting device includes a lifting arm arrangement having a free end, which can be raised and lowered in relation to the base and supports the lifting sling. The aid apparatus may turn over if the person leans at one side in a standing position and a fork-shaped lateral support is therefore arranged, the open end of which opens in the direction from the post and surrounds the upper part of the body when the person is in the standing position. The breadth of the fork-shaped lateral support corresponds to the person's breadth and is not larger than the breadth of the U-formed base. The fork-shaped lateral support being arranged not swingable in relation to an axis, which is perpendicular to the plane of the U-formed base.

4 Claims, 1 Drawing Sheet

LATERAL SUPPORT OF A HOIST

The invention relates to an aid apparatus for lifting a disabled person from a sitting to a standing position, which apparatus comprises a wheeled base in the form of a U-formed frame having a post, which supports a lifting means, in which a lifting sling can be fixed for being applied at least partly around the body of the person, which lifting means includes a lifting arm arrangement having a free end, which can be raised and lowered in relation to the base and supports the lifting sling.

An apparatus of this kind is known from e.g. SE-A-8402899-2. By this known apparatus the person is lifted from a sitting to a standing position by means of two swinging arms attached to a post and a sling, which is fixed to the swinging arms and is extended from one of the swinging arms downwards under one of the armpits, further around the back of the person and under the second armpit and up to the second swinging arm. By that the person is lifted and is held by means of the sling under the armpits. The lateral stability of the person will be bad in the standing position. This goes specifically for persons having weak arms and legs, who are those needing such an aid apparatus in order to get up. It has been proved that if the person bends himself to one side only a few degrees from vertical position this could result in that the complete aid apparatus will turn over. Thus, it is very important to prevent the air apparatus from turning over if the person standing on the plate of the aid apparatus leans at one side and the object of the invention is to make sure that the person can not lean at any side.

Above stated object is reached by the invention by that the invention has the features which are stated in the characterizing part of enclosed claims.

An embodiment of the invention will now be described with reference to enclosed drawings.

Figure 1:
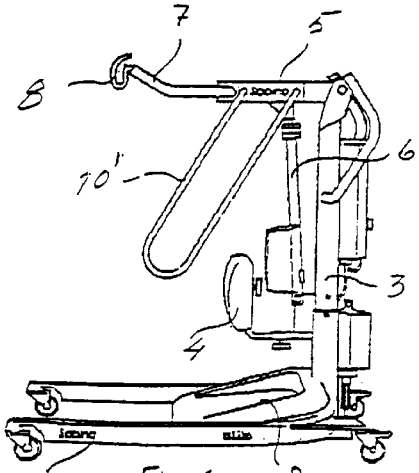
FIG. 1 is hereby a side view of the apparatus according to the invention.
Figure 2:
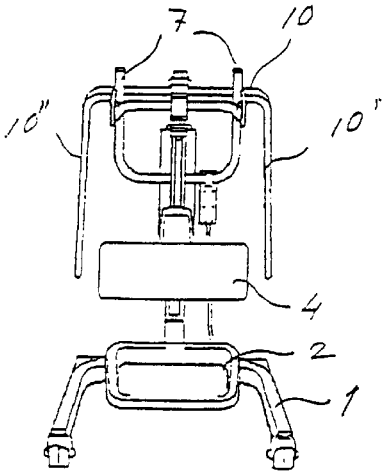
FIG. 2 is a view from behind of the apparatus.

FIG. 1 thus shows the apparatus according to the invention from left side. The apparatus comprises a wheeled base 1, which is U-formed. The base has a foot plate 2 and a post 3. The post includes a knee support 4, which is adjustable in the direction to and from the post 3. The post supports in its upper end a swinging arm 5, which is driven to swing upwards and downwards in the vertical plane by means of an electric or hydraulic driving means, which is denoted by 6. The swinging arm 5 has an extension from its free end in the form of two arms 7, which are extended parallel to each other having a certain distance between themselves. The ends of the arms 7 have each a hook 8, from which a lifting sling 9 is suspended, see FIGS. 4 and 6.

A fork-shaped lateral support 10 is fixed to the swinging arm 5 and consists thus of two arms 10" and 10'. The arms 10' and 10" thus form a U-form which corresponds essentially to the U-form of the base 1. The open end of the U-form is in the same direction as for the U-form of the base. The distance between the arms 10' and 10" corresponds approximately to the shoulder of the person and is not greater than the distance between the two bones of the base 1.

By that of the fork-shaped lateral support 10 is fixed to the swinging arm 5 it will follow the motion of the swinging arm upwards and downwards and opposite. In FIG. 1 the swinging arm 5 is shown approximately in its starting position whereat the arms 10' and 10" of the lateral support 10 are directed downwards.

FIGS. 3 to 6 show how to make use of the aid apparatus and before all how the lateral support functions. As can be seen from FIG. 3 a person in a wheel chair has been moved up to the aid apparatus and placed his feet on to the footplate 2. The swinging arm is swinged downwards to approximately horizontal position and a lifting sling 9 is brought round the body approximately breast-high but as close as possible to the centre of gravity of the person. The lifting sling is thereafter fastened to the hooks 8 of the extensions 7 of the swinging arm 5. It should be noted that two extended arms 7 have been described in the foregoing but the swinging arm 5 can also be extended by only one arm 7 having one hook 8, from which the lifting sling is suspended.

Figure 3:
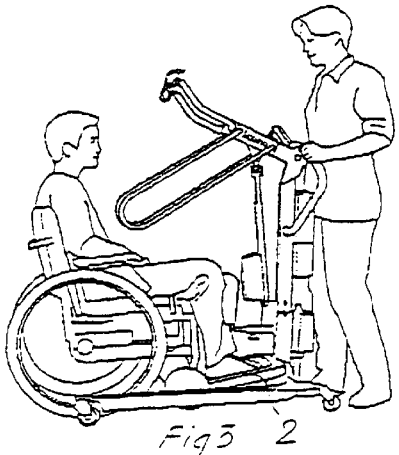
FIG. 3 is a view showing the first step in using the apparatus according to the invention.
Figure 4:
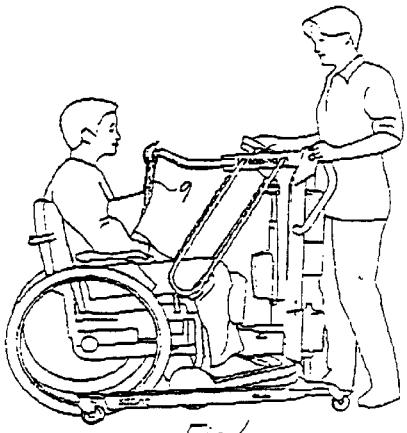
FIGS. 4, 5 and 6 show consecutive steps of the use of the apparatus according to the invention until the person in question has been lifted to standing position.
Figure 5:
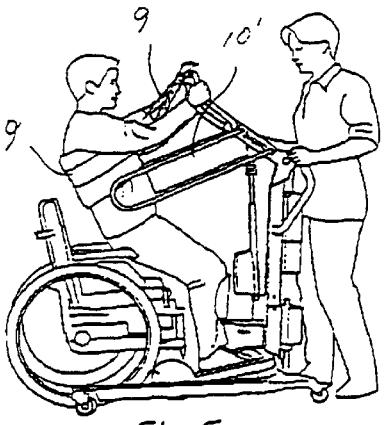
Figure 6:
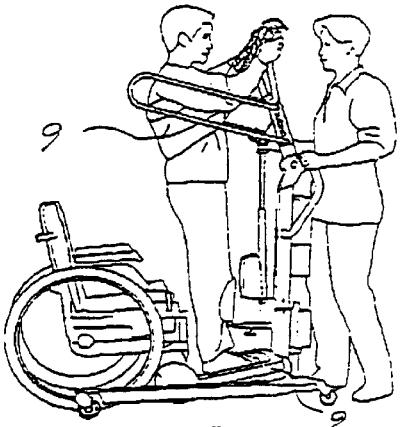

As can be seen from FIG. 4 the lifting sling is now attached to the hooks and is placed around the back of the patient. The two arms 10' and 10" of the fork-shaped lateral support 10 are directed inclined downwards outside the knees of the person. In FIG. 5 the lifting means has been raised so that the swinging arm is swinged somewhat upwards and the person is in a half-standing position. The two arms 10' and 10" of the fork-shaped lateral support are now approximately at the waist height of the person. FIG. 6 shows the person in upstanding position on the foot plate 2. The person holds his hands on the extensions 7 of the swinging arm 5 and the sling 9 is extended round the back of the person. The person having strong arms can in this way keep himself safely standing on the footplate 2 even if the aid apparatus is moved on its wheels. A person having weak arms and legs will not manage to stand steady on the footplate 2 when the aid apparatus is moved on its wheels. In order to assist such a person to stand steady on his feet the fork-shaped lateral support is arranged and the arms 10' and 10" of the lateral support are now in the shown position just outside the arms of the person as shown. It is also a possibility to arrange the arms 10' and 10" under the person's arms and support the body under the arms.

The fork-shaped lateral support 10 prevents the person to lean at any side and hereby the aid apparatus is prevented from turning over. It is also possible within the inventive idea to arrange means for adjusting the distance between the two arms 10' and 10" so that the lateral support can be adapted to the person's breadth. The lateral support may alternatively be fixed swingable to the arm 5 so that the arms 10' and 10" can be adapted to the person's length. The described embodiment shows that the fork-shaped lateral support is fixed to a swinging arm 5. It is however also possible to design the aid apparatus so that instead of a swinging arm 5 the apparatus includes an approximately horizontal lifting arm, which by hydraulic means can be raised in relation to the post 3 and without any swinging motion in the vertical plane. In this case the fork-shaped lateral support can be fixed on the part of the lifting arm which is moved upwards and downwards in relation to the post 3 so that it hereby is brought to the correct height in relation to the standing person.

What is claimed is:

1. Aid apparatus for raising a disabled person from a sitting position to a standing position, which apparatus includes a wheeled base in the form of a U-formed frame having a post, which supports a lifting means, in which can be fixed a lifting sling to be applied at least partly around a person's body, which lifting means includes a lifting arm arrangement having a free end, which can be raised and lowered in relation to the base and supports the lifting sling, the aid apparatus comprising a driven, vertically swingable fork-shaped lateral support performing a lifting action, an open end of which opens in a direction from the post and surrounds an upper part of the body when the person is in a standing position, whereat a breadth of the fork-shaped lateral support corresponds to the person's breadth and is not larger than a breadth of the U-formed base, said fork-shaped lateral support being arranged not swingable in relation to an axis, which is perpendicular to a plane of the U-formed base.

2. Aid apparatus according to claim 1, wherein an arm of the lifting arm arrangement is swingable upwards and downwards around an axis which is perpendicular to the post, the fork-shaped lateral support is firmly fixed to the arm and follows its swinging portion.

3. Aid apparatus according to claim 1, wherein a separation distance of arms forming the fork-shaped lateral support can be adjusted.

4. Aid apparatus according to claim 1, wherein a height of the lateral support is adjustable in relation to the base.

* * * * *